United States Patent [19]

Bourdeau

[11] 4,217,082

[45] Aug. 12, 1980

[54] SPIN CUP MEANS FOR THE PRODUCTION OF METAL POWDER

[75] Inventor: Romeo G. Bourdeau, Tequesta, Fla.

[73] Assignee: United Technologies Corporation, Hartford, Conn.

[21] Appl. No.: 862,897

[22] Filed: Dec. 21, 1977

[51] Int. Cl.[2] ..... B29C 23/00

[52] U.S. Cl. ..... 425/8; 264/8

[58] Field of Search ..... 425/9, 8, 500, 517; 264/8; 164/46, 47; 65/8, 15

[56] References Cited

U.S. PATENT DOCUMENTS

| | | | |
|---|---|---|---|
| Re. 12,568 | 11/1906 | Cowing | 425/8 |
| 1,095,523 | 5/1914 | Rockwell | 164/46 |
| 2,156,982 | 5/1939 | Harford et al. | 65/8 X |
| 2,439,772 | 4/1948 | Gow | 425/8 X |
| 3,907,537 | 9/1975 | Logens-Bogh | 425/8 X |
| 4,053,264 | 10/1977 | King | 425/8 |

FOREIGN PATENT DOCUMENTS

| | | | |
|---|---|---|---|
| 545121 | 8/1957 | Canada | 425/8 |

*Primary Examiner*—Mark Rosenbaum
*Attorney, Agent, or Firm*—Jack N. McCarthy

[57] ABSTRACT

An apparatus is set forth wherein powder is produced by melting metal in a melting furnace and then directing it onto an atomizer rotor or cup. The atomizer cup is positioned to receive molten metal at the center thereof and is rotated by any means desired. The cup comprises an outer metal cup fixed to the top of a rotating shaft, with an inner cup mounted in the center thereof and spaced therefrom by an outwardly extending flange at the top. A low conductivity thermal insulation is provided between the cups, and the inner cup is coated with a ceramic such as by plasma or flame spray. The inner cup is tapered inwardly as it extends from its bottom to the top edge to provide an annular pool of molten metal around the inner surface permitting the liquid metal to attain the peripheral speed fo the spinning cup as it moves from the center of the cup to the top edge.

A heater is provided to preheat the cup and during operation to aid in keeping the cup surface above the melting point of the liquid metal. This will help prevent premature freezing of the liquid metal before it reaches the quenching medium into which the particles are being thrown.

15 Claims, 4 Drawing Figures

SPIN CUP MEANS FOR THE PRODUCTION OF METAL POWDER

CROSS-REFERENCE TO RELATED APPLICATION

Application Ser. No. 862,898, now U.S. Pat. No. 4,178,335 to Robert A. Metcalfe et al for "ROTARY ATOMIZATION MEANS FOR THE PRODUCTION OF METAL POWDER" and application Ser. No. 862,899, now U.S. Pat. No. 4,140,462 to Charles C. Thompson for "COOLING MEANS FOR METAL ATOMIZATION MEANS" are being filed herewith and disclose related arrangements.

BACKGROUND OF THE INVENTION

This invention relates to apparatus for the formation of metal powders which are cooled at high rates, and more particularly to the use of an atomizer rotor, or cup, for receiving molten metal and flinging it radially outwardly from the rotor as liquid metal droplets. Specific apparatus for using an atomizer rotor, or cup, as disclosed in this application, is shown in U.S. Pat. Nos. 4,025,249 and 4,053,264. A further disclosure of an apparatus and method for using such a rotor cup is set forth in application Ser. No. 654,247 now abandoned and application Ser. No. 751,004, now U.S. Pat. No. 4,078,873. Other prior art patents showing various types of cups are listed below: U.S. Pat. No. 2,062,093; U.S. Pat. No. 2,310,590; U.S. Pat. No. 2,439,772; U.S. Pat. No. 2,439,776; U.S. Pat. No. 2,699,576; U.S. Pat. No. 3,196,192; and U.S. Pat. No. 3,329,746. It is noted that the atomizing cup can be used with many different types of apparatus and in different methods for producing metal powder.

SUMMARY OF THE INVENTION

According to the present invention, an atomizer rotor, or cup, is set forth for use in apparatus for the manufacture of metal powders.

It is an object of this invention to provide an atomizing cup which is spun by any means desired for the atomization of liquid metal. The cup is constructed having an outer body with a refractory sheet metal insert with a low conductivity thermal insulator between the body and insert. This construction reduces heat losses to a quantity which can be readily supplied by a superheated liquid metal.

It is a further object of this invention to provide an inner cup which is tapered inwardly as it extends from its bottom to the top edge to provide an annular pool of molten metal to aid the liquid metal in attaining the peripheral speed of the spinning cup as it reaches the top edge of the inner cup. A ceramic liner or ceramic coating is applied to the inner cup to resist erosion by the molten metal. The ceramic also keeps the cup edge as smooth as possible.

It is a further object of this invention to provide means for both preheating the cup and maintaining the spinning cup at a temperature above the melting point of the liquid metal. The heater can be a donut-type radiant heater, or a heater directing a heated gas over the cup surface.

It is another object of this invention to provide a hot spinning cup for preventing the uncontrolled formation of a metal skull around the outer surface and over the upper edge. The uncontrolled formation of a metal skull will produce a severe imbalance in the system and the metal skull provides rough channels which produce particles of uncontrolled size and shape.

DESCRIPTION OF THE PREFERRED EMBODIMENT

Figure 1:
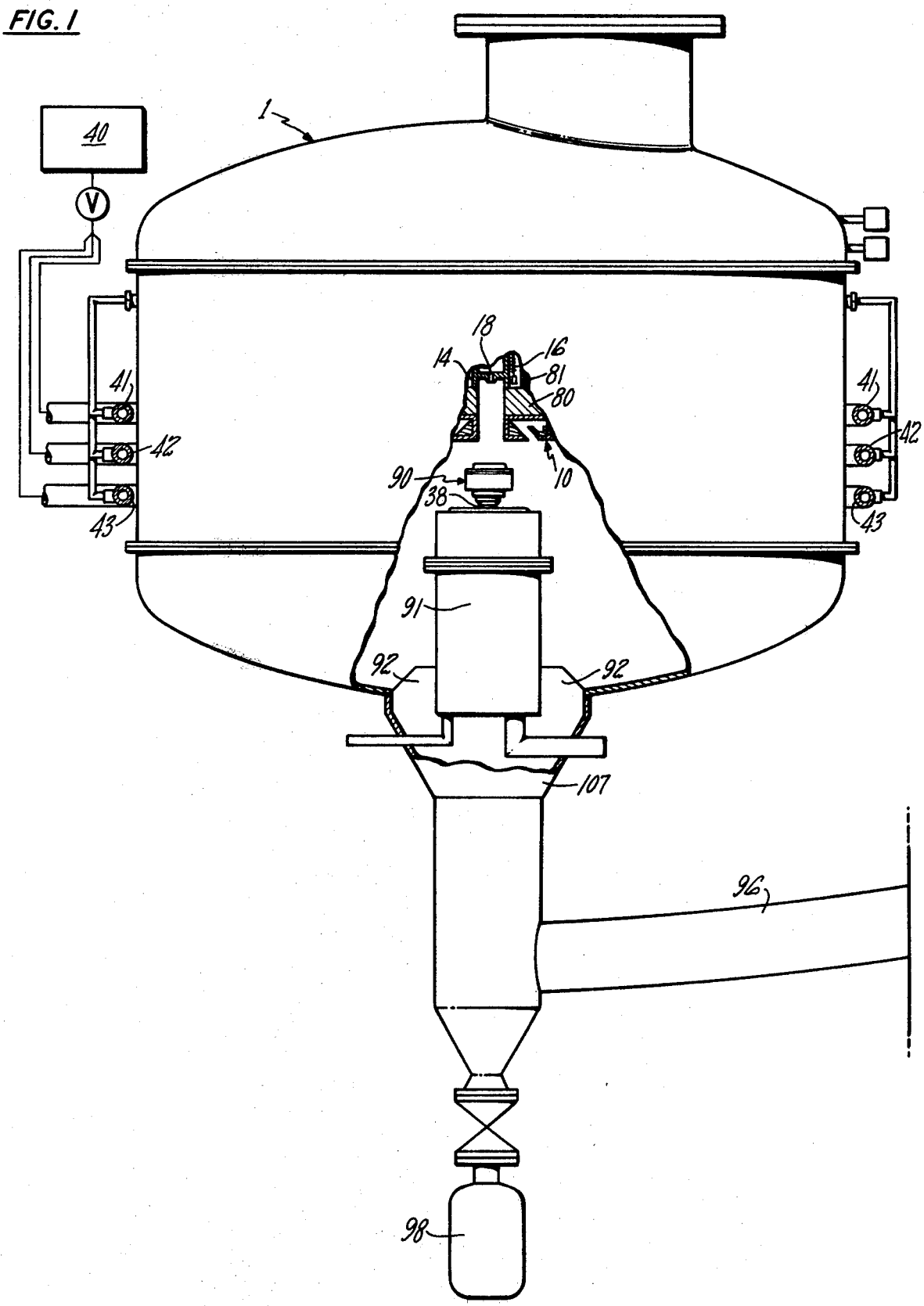
FIG. 1 is a view of an apparatus for making metal powder with the housing broken away to show the spin cup.

The apparatus for making metal powders shown in FIG. 1 is fully described and shown in U.S. Pat. No. 4,025,249. Basically, metal is melted in a crucible (not shown) in the upper part of the housing 1 where it is then poured into tundish 14 which directs the molten metal onto a spinning cup means 90. The tundish 14 includes a restricted opening, or nozzle, 18. A heater 16 extends around the tundish 14 and can be one of many types with controls mounted externally of the housing 1. Heat shields 81 are located around the heater 16 and a heat shield disc means 80 is positioned below the heater 16 and heat shields 81. The heat shield disc means 80 has a center opening. An annular nozzle plate means 10 has its inner end positioned against the heat shield disc means 80, the center opening of the heat shield disc means 80 being aligned with the center opening in the annular nozzle plate means 10. Said annular nozzle plate means 10 extends outwardly to the inner surface of the housing 1.

The center opening of the heat shield disc means 80 and the center opening of the annular nozzle plate means 10 are placed under the restricted opening 18 of the tundish 14 to allow the molten metal passing therefrom to pass through to the cup means 90. The nozzle plate means 10 includes a plurality of annular nozzles therein for directing a cooling fluid downwardly around the cup means 90. A specific nozzle plate means is shown and claimed in U.S. Pat. No. 4,053,264. The molten metal is spun from the cup means 90 into the cooling fluid where it is cooled to solid metal particulate. Cooling fluid is maintained in a coolant supply means 40 where it is directed to three external annular manifolds 41, 42 and 43. Each manifold 41, 42 and 43 is connected by conduits, respectively, to said annular nozzles in nozzle plate means 10. Means are provided to control the total mass flow of cooling fluid in a desired manner between the nozzles.

The cup means 90 is positioned below the tundish 14 with the center of the disc being positioned under the nozzle 18. The device is rotated by any means desired, such as by an air turbine, and is mounted for rotation on the end of an upstanding pedestal 91 which is fixed to flat struts 92 in a funnel member 107 at the bottom of the housing 1. The solid particles formed by the molten metal being flung into the cooling fluid are collected in a container 98. A conduit 96 can lead to other separators and collectors, if desired, and can also direct the cooling fluid to heat exchange devices (not shown) so that it can be returned to the supply means 40.

Figure 2:
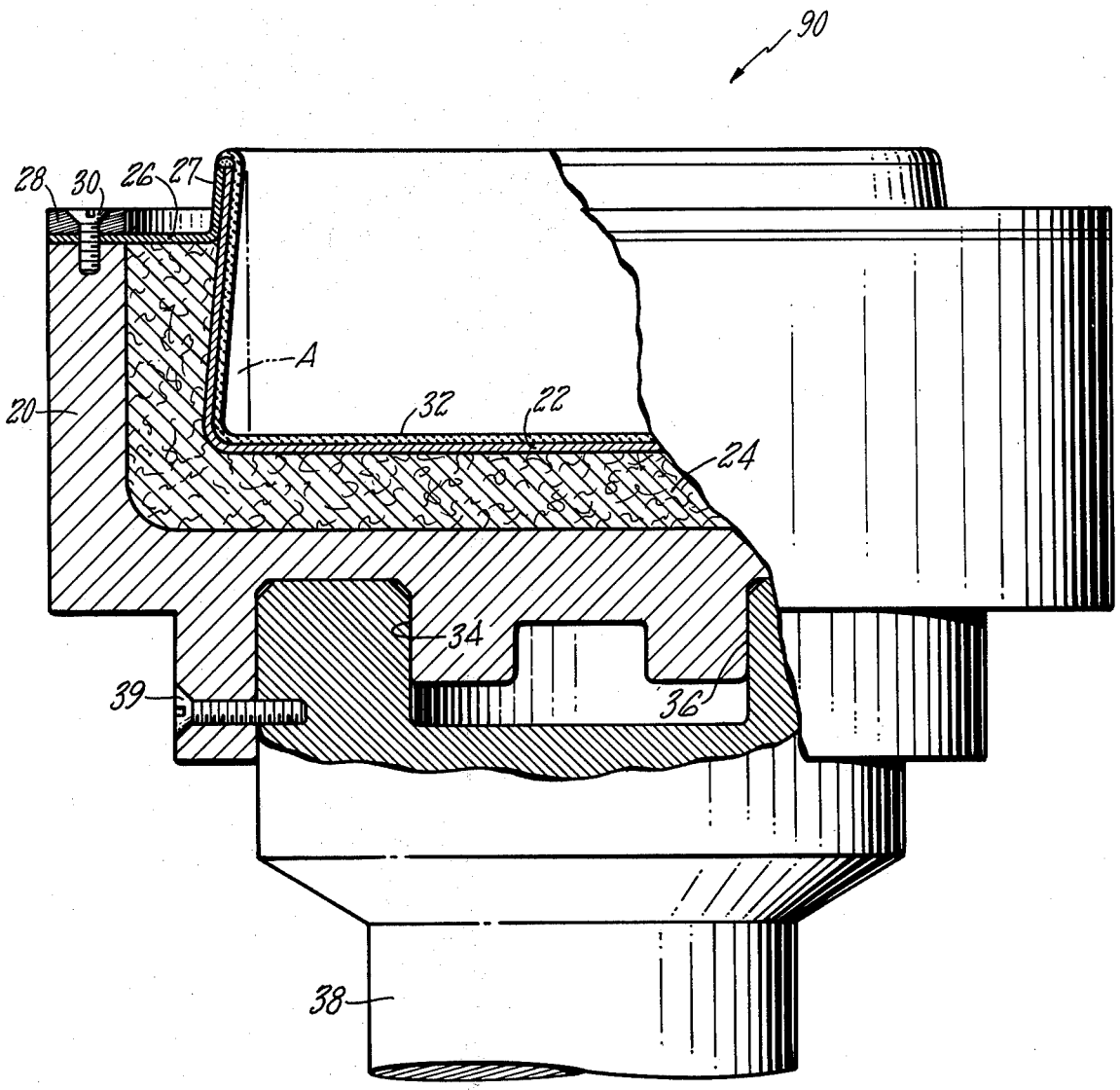
FIG. 2 is an enlarged view of the spin cup.

As shown in FIG. 2, the cup means 90 comprises an outer cup 20 having a refractory sheet metal cup insert 22 positioned therein and spaced therefrom to provide for a low conductivity thermal insulator 24. The low-conductivity thermal insulator 24 can be formed of felt-like zirconia fibers. The sheet metal cup insert 22 is formed having an outwardly extending annular flange 26 at a midpoint thereof for engagement with the top of the outer cup 20. While an annular flange can be attached by any number of known ways, FIG. 2 shows the flange 26 connected to the bottom of a short cylindrical member 27. The top of the cylindrical member 27 is welded or brazed to the top of the sheet metal cup insert 22. A hold-down ring 28 is placed over the end of the annular flange 26 above the top of the outer cup 20; this hold-down ring is bolted down to the cup by bolts 30. A ceramic coating 32, such as of $ZrO_2$, $Al_2O_3$, $MgZrO_3$ or other suitable refractory ceramic, is placed over the interior of the refractory sheet metal cup insert 22 extending over the top edge thereof and over the weld, or braze, material and top edge of the cylindrical member 27. The sheet metal cup insert 22 is tapered inwardly as it extends from its bottom to the top edge to provide an annular pool A of molten metal around the tapered inner surface. In a construction made, the angle of taper of the sheet metal cup insert was 5°. The bottom of the outer cup 20 is formed having an annular recess 34 for receiving an upwardly projecting annular flange 36 on the top of a shaft 38, said shaft 38 being mounted for rotation in an upstanding pedestal 91. Bolts 39 extend through the outer cup 20 into the upwardly projecting annular flange 36 on the top of the shaft 38 to fix the outer cup 20 thereto.

Figure 3:
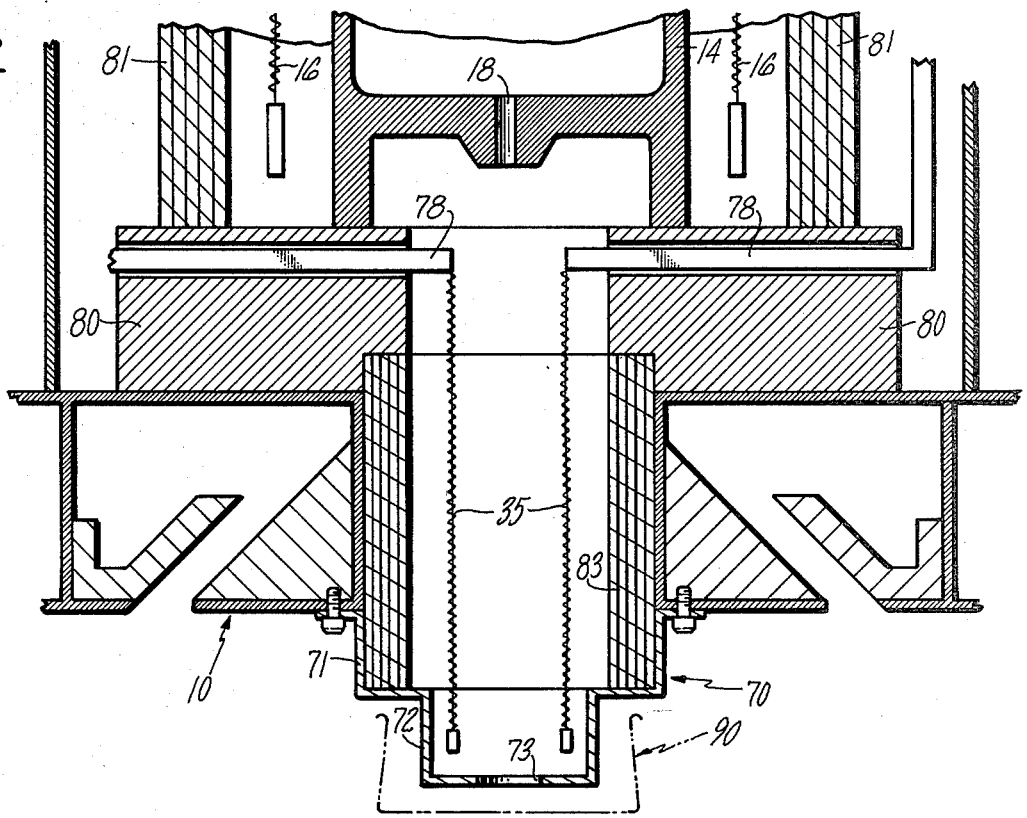
FIG. 3 is a view of the interior of the spin cup in phantom with a heating means for controlled heating of said cup.

As shown in FIG. 3, additional heater means 35 are provided to preheat the atomizing rotor, or cup means, 90 and provide heat around the molten metal flowing below the heater 16 which is provided around the tundish 14. The heater means 35 extends from adjacent the bottom of the tundish 14 to a location within the cup means 90. Cylindrical heat shields 83 extend downwardly from an annular recess in the heat shield disc means 80 and extend within the inner opening in the annular nozzle plate means 10 to a point extending just below the bottom surface thereof. A sheet metal cover means 70 is fixed to the bottom of annular nozzle plate means 10 and has a large cylindrical section 71 enclosing the bottom ends of the heat shields 83 and a smaller cylindrical section 72 enclosing the bottom of the heater means 35. The annular heat shields 83 are fixed in position between the annular recess in the heat shield disc means 80 and the step portion between the two cylindrical sections 71 and 72 of the sheet metal cover means 70. The lower cylindrical portion 72 has a bottom, having an opening 73 therein which is aligned with the restricted opening 18 of the tundish 14 to permit a stream of molten metal therefrom to enter the cup means 90. This lower end of the cylindrical section 72 projects into the sheet metal cup insert 22, heating the interior of the cup means 90 and maintaining the heat in the molten metal. The heater means 35 can be a resistance-type heater with electrodes 78 being connected to controls externally of the housing 1.

Figure 4:
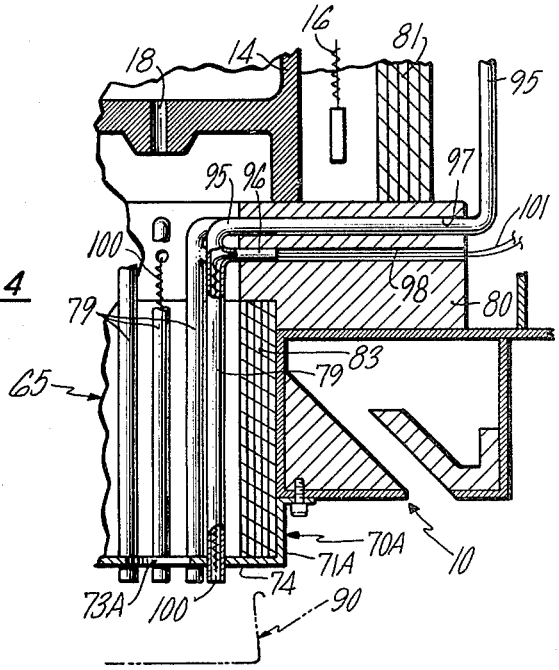
FIG. 4 is a view of a portion of the interior of the spin cup in phantom with a portion of a modification of a heating means for controlled heating of said cup.

As shown in FIG. 4, a modified heater means 65 is provided to preheat the atomizing rotor or cup means 90 and provide heat around the molten metal flowing beneath the heater 16 which is provided around the tundish 14. The heater means 65 extends from adjacent the bottom of the tundish 14 to a location above the cup means 90 where it directs a heating gas flow into the cup means 90. Cylindrical heat shields 83 extend downwardly from an annular recess in the heat shield disc means 80 and extend within the inner opening in the annular nozzle plate means 10 to a point extending just below the bottom surface thereof. A sheet metal cover means 70A is fixed to the bottom of annular nozzle plate means 10 and is formed as a cylindrical section 71A enclosing the bottom ends of the heat shield 83 and has a bottom annular flange 74 extending radially inwardly further to an ope ning 73A therein. As shown in FIG. 3, the cylindrical heat shields 83 are fixed in position between the annular recess in the heat shield disc means 80 and the bottom annular flange 74 of the cylindrical section 71A of cover means 70A. The opening 73A is in line with the restricted opening 18 of the tundish 14 to permit a stream of molten metal therefrom to enter the cup means 90.

A plurality of tubes 79 are located adjacent the inner surface of the cylindrical heat shield 83 and extend upwardly into the center opening of the heat shield disc means 80 and downwardly through the bottom of annular flange 74 of the sheet metal cover means 70 between said annular heat shield 83 and the edge of opening 73A. The tubes 79 are fixed to the bottom annular flange 74 of cover means 70A, such as by welding.

The upper end of each tube 79 has one tube 95 extending from the top thereof radially outwardly through an elongated opening 97 in heat shield disc means 80 to a gas supply having a flow meter control (not shown) located outside of said housing 1, and a second tube 96 extending from a point spaced from the top thereof radially outwardly into another elongated opening 98 in heat shield disc means 80. Each tube 79 has a resistance heater 100 extending along its length with control conduits 101 extending through tubes 96 and elongated openings 98 to a power controller (not shown) located externally of the housing 1. It can be seen that gas from a gas supply can have its flow directed down through tubes 95 to tubes 79 where the gas then flows over the resistance heaters 100 and into the cup means 90; at the same time the heat of the resistance heaters can be controlled by the power controller. To prevent any adverse reaction to the molten metal, the gas supply could be an inert gas, such as helium or argon.

I claim:

1. An atomizer rotor for receiving a flow of molten metal and flinging it radially outward to produce solid metal particles comprising an outer metal cup, means for rotating said metal cup, an inner metal cup having an upstanding wall and bottom, means for positioning said inner metal cup in said outer metal cup while spacing it from said outer metal cup around its upstanding wall and bottom, the upper edge of said inner metal cup being positioned above the upper edge of said outer metal cup, said inner cup being fixed to said outer cup by annular flange means extending from the upstanding wall of said inner metal cup to said outer metal cup.

2. A combination as set forth in claim 1 wherein said inner cup is fixed to the upper edge of said outer cup by an annular flange extending outwardly from said inner cup and over said outer cup.

3. A combination as set forth in claim 1 wherein insulation means is placed between said spaced inner cup and outer cup.

4. A combination as set forth in claim 3 wherein said insulation means is formed of felt-like fibers.

5. A combination as set forth in claim 3 wherein said insulation means is formed of felt-like zirconia fibers.

6. A combination as set forth in claim 1 wherein the inner cup is coated with a ceramic.

7. A combination as set forth in claim 1 wherein the inner wall of said inner cup tapers inwardly as it extends upwardly to provide an annular pool of molten metal around the inner surface of the inner cup permitting the liquid metal to attain the peripheral speed of the cup when it is rotating.

8. An atomizer rotor for receiving a flow of molten metal and flinging it radially outward to produce solid metal particles comprising an outer cup, means for rotating said cup, an inner cup, said inner cup being fixed to and spaced from said outer cup, the upper edge of said inner cup being positioned above the upper edge of said outer cup, and heating means being located adjacent the upper edge of said inner cup for heating said cup.

9. A combination as set forth in claim 8 wherein said heating means is made cylindrical to receive a flow of molten metal down the center thereof, the bottom of said heating means having an opening for permitting the flow of molten metal to flow to the bottom of the inner cup.

10. A combination as set forth in claim 9 wherein heat shield means are positioned around the heating means to retain the heat therein.

11. A combination as set forth in claim 9 wherein the heater means is a resistance-type heater means.

12. A combination as set forth in claim 11 wherein said heating means provides a flow of gas over the resistance-type heater means which is directed into the inner cup.

13. A combination as set forth in claim 11 wherein said resistance-type heater means extends into the inner cup.

14. A combination as set forth in claim 12 wherein said gas is an inert gas such as helium or argon.

15. A combination as set forth in claim 8 wherein said heating means includes a plurality of tubes which are positioned in a cylindrical pattern, each tube having a resistance-type heater located therein, a supply of gas being directed to the top of each of said tubes, the bottom of each of said tubes opening into the inner cup.

* * * * *